United States Patent [19]

Szczepanski

[11] 4,186,882

[45] Feb. 5, 1980

[54] ATOMIZING LIQUID DISPENSER

[76] Inventor: Harry Szczepanski, 755 Oakleigh Rd., NW., Grand Rapids, Mich. 49504

[21] Appl. No.: 858,849

[22] Filed: Dec. 8, 1977

[51] Int. Cl.[2] ..... B05B 11/04

[52] U.S. Cl. ..... 239/327; 222/212; 222/479; 222/489

[58] Field of Search ..... 222/209, 211, 212, 376, 222/489, 464, 382, 479, 481.5, 494; 239/327

[56] References Cited

U.S. PATENT DOCUMENTS

| | | | |
|---|---|---|---|
| 2,808,182 | 10/1957 | Furedi | 222/479 |
| 2,812,113 | 11/1957 | Beall | 222/551 X |
| 2,986,310 | 5/1961 | Spaulding | 222/481.5 |
| 3,127,068 | 3/1964 | Sutter | 222/209 |
| 3,140,052 | 7/1964 | McCuiston | 239/327 |
| 3,176,883 | 4/1965 | Davis | 222/211 X |
| 3,241,726 | 3/1966 | Chester | 222/211 |
| 3,726,436 | 4/1973 | Despain et al. | 222/494 X |
| 3,794,247 | 2/1974 | Corsette | 222/211 X |
| 4,024,992 | 5/1977 | Schmid | 239/327 X |

*Primary Examiner*—F. J. Bartuska

*Attorney, Agent, or Firm*—Glenn B. Morse

[57] ABSTRACT

A manually deformable container utilizes air pressure resulting from squeezing the container to project a jet of liquid. Some of the pressurized air is ejected around the liquid jet to assist in atomization. A nozzle unit is supported on a transverse perforate plate preferably interposed between the container and a threaded closure member defining an air-discharge orifice around the end of the nozzle. Alignment of the nozzle with respect to the orifice is provided by either a lateral shiftability of the plate, a self-centering action of the plate in the container, or by a diaphragm deflection of the plate as the nozzle may tilt in finding its own way into the air orifice. An axial diaphragm deflection of the plate is used to provide a resilient seal of the liquid nozzle by tightening a screw cap against a projecting end of the nozzle, preferably followed by a sealing of the air orifice as the cap is further tightened. Leakage seals in air and liquid passages are provided, and also a container configuration facilitating dispensing in inclined positions of the container without interference with the air-liquid dispensing ratios.

1 Claim, 19 Drawing Figures

FIG. 7
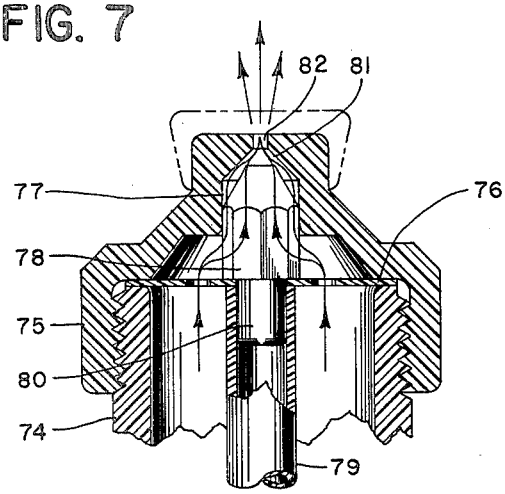
FIG. 8
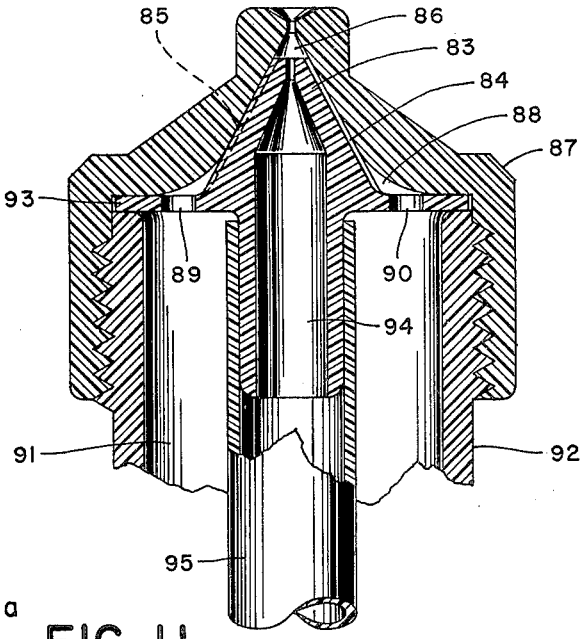
FIG. 11
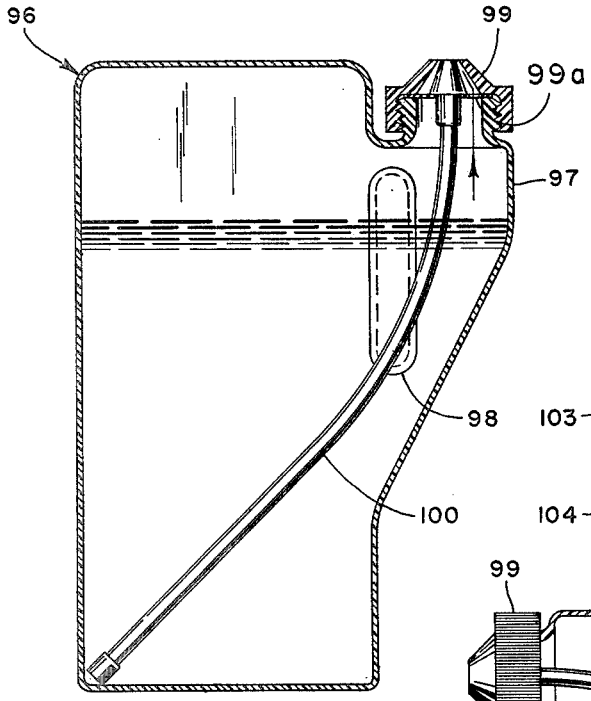
FIG. 9
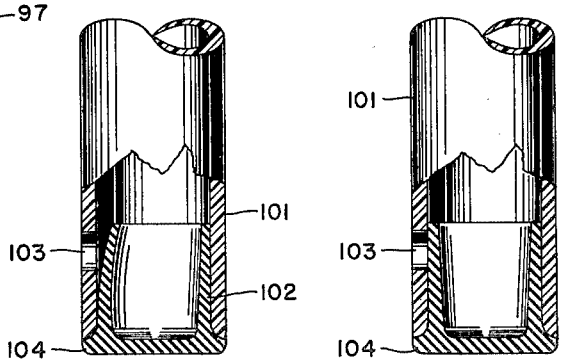
FIG. 12
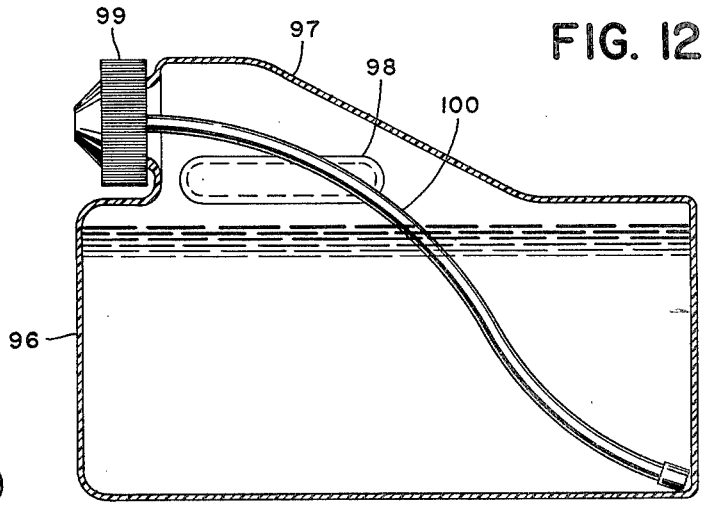
FIG. 10

ATOMIZING LIQUID DISPENSER

BACKGROUND OF THE INVENTION

Present development of liquid-dispensing containers is in the direction of finding alternatives to the aerosol system in the interest of both the prevention of air pollution, and the reduction of cost to dispense a given quantity of liquid. Hand or finger-operated pumps inserted in the open end of containers are now used frequently, as are the familiar squeeze bottles commonly used to dispense practically all forms of liquid from deodorants to window-washing compounds. A number of plastics have been developed for the use of manually-deformable squeeze bottles, and the present invention is associated with this type of device. The simple principle of operation involves generation of pressure inside the container whenever it is squeezed, the pressure being utilized to eject a jet of a contained liquid. Entrapped air within the container is occasionally used to form a high velocity air jet adjacent the projected liquid to facilitate atomization. Usually, a tube will lead from the liquid nozzle down to the bottom of a container so that liquid can continue to be drawn off, instead of merely air, as the container is progressively emptied. My co-pending application Ser. No. 781,748 now U.S. Pat. No. 4,087,023 discloses the mounting of a nozzle unit on a perforate transverse plate having its peripheral edge entrapped between the end of the container and the closure member to support the nozzle. The present invention is directed at utilizing this principle of construction in a single-container device more readily adaptable to current forms of containers and automated filling equipment at a reduced cost.

SUMMARY OF THE INVENTION

A squeeze-bottle is provided with a liquid-dispensing nozzle mounted on the transverse perforate plate entrapped between the end of a container defining its opening and the closure member normally covering this opening. The closure member also defines an air-discharge orifice surrounding the nozzle member. In one form of the invention, the plate is relatively thin, and capable of a diaphragm deflection permitting the nozzle unit to tilt slightly as it finds its way into the air orifice as a closure member is tightened. Alternatively, the plate is provided a sufficient lateral freedom of movement to accommodate the self-alignment of the nozzle in the air orifice as the cap is tightened. In another form of the invention, the nozzle-plate sub-assembly is centered with respect to the air-discharge orifice by a self-alignment of the plate with respect to the mouth of the container. Diaphragm deflection is utilized in a purely axial direction in one form of the invention as the projection end of the nozzle is engaged by a cap in the process of tightening the cap. The continued tightening of the cap resiliently closes off the liquid-discharge orifice, and then the air orifice around it. An inclineable container is provided in which the air-liquid dispensing ratios are maintained in various angular positions of the container with respect to the horizontal, and special valve devices are incorporated in both the air and liquid passages to prevent leakage, along with a float at the free end of an air intake tube which will maintain the intake within the contained air mass in all attitudes of the container.

DESCRIPTION OF THE DRAWINGS

FIG. 7 illustrates a further modification of the invention utilizing a different configuration defining an air passage between the nozzle and the closure member, and a self-alignment interengagement similar to aht incorporated in FIG. 6.

FIG. 8 illustrates a further modification of the invention, incorporating a one-piece nozzle-plate unit with self-alignment between the nozzle unit and the closure member.

FIG. 9 is a side elevation showing an inclineable container in the upright position.

FIG. 10 illustrates the container of FIG. 9 in a horizontal position, in which the dispensing characteristics remain the same.

FIGS. 11 and 12 illustrate the open and closed positions of a valve unit incorporated in the liquid tube of the device shown in FIG. 9.

DESCRIPTION OF THE PREFERRED EMBODIMENTS

Figure 1:
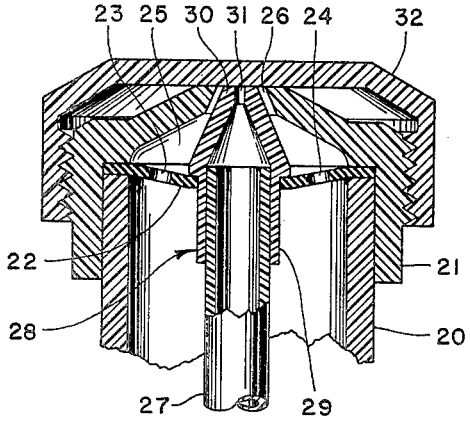
FIG. 1 is an axial section of the upper extremity of a squeeze bottle, showing the sealed condition induced by tightening a cap against the liquid and air orifices.
Figure 2:
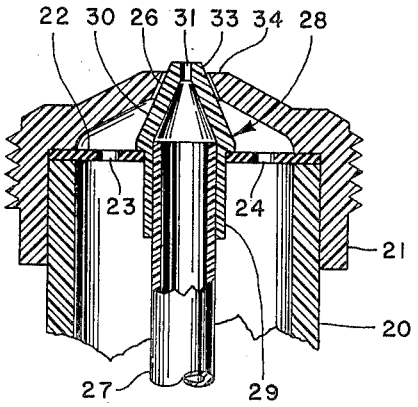
FIG. 2 is a section similar to FIG. 1, showing the cap removed, and the unit in condition for use.

Referring to FIGS. 1 and 2, the neck of a conventional squeeze bottle is indicated at 20, which forms a part of a manually-deformable container for practically any kind of liquid to be dispensed. The closure member 21 is slipped over the end of a neck 20, and is adhesively secured in position. During this assembly process, the perforate transverse plate 22 is interposed between the end of the neck 20 and the closure member 21. This plate contains a number of holes as indicated at 23–24 in angularly spaced relationship about the center of the plate to form passages for air moving out through the neck 20 underpressure as the container is squeezed. This air moves through the space 25 defined by the closure member 21, and out through the conical air-discharge orifice 26. Liquid moves up through the tube 27 under the urging of this same air pressure, and moves through the nozzle unit 28 having the cylindrical lower extension 29 received in a press fit relationship in the central opening in the plate 22. Preferably, the tube 27 is adhesively secured to the inside diameter of the extension 29. A conical upper end 30 of the nozzle unit 28 is generally similar on its exterior surface to the conical surface of the air orifice 26, and the space between them provides a passage for the discharge of the pressurized air, directed generally toward the axis of the device to assist in the atomization of the liquid discharged through the orifice 31.

The plate 22 is capable of a resilient deformation under the axial pressure provided by the cap 32 as it is tightened down in its threaded engagement with the closure member 21. The deflected condition of the plate 22, acting as a diaphragm, is shown in FIG. 1. The resulting resilient pressure forms a seal across the liquid-discharge orifice 31 as the cap first engages the outer surface 33 of the nozzle element 28. With the continued tightening of the cap 32, the deflection of the plate 22 continues until the underside of the cap 32 bears also against the end surface 34 of the closure member 21 to seal off the air-discharge orifice 26. Under these conditions, the container is obviously fully sealed. As the cap is subsequently unscrewed to prepare the dispenser for use, the resilient of the plate 22 restores it to the position shown in FIG. 2, in which the end of the nozzle projects somewhat beyond the surface 34, but still leaves a space between the end of the nozzle unit and the air orifice 26 to provide the necessary air passage.

Figure 3:
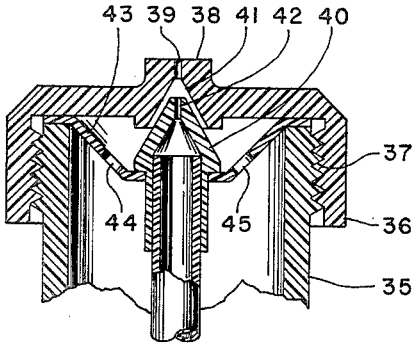
FIG. 3 illustrates a modified form of the invention incorporating an offset transverse perforate plate, illustrating a self-centering relationship of the plate with respect to the container and closure member.

Referring to FIG. 3, a modified form of the invention is illustrated in which the container 35 has threaded engagement with a closure member 36 as indicated at 37. The end surface 38 of the closure member contains the discharge orifice 39 for the intermixture of air moving between the conical surface of the nozzle 40 and the similar conical surface 41 of the closure member. Liquid moving out through the orifice 42 of the nozzle is thus intimately intermixed with the pressurized air before moving outwardly through the orifice 39. The nozzle 40 is received in a press fit in a central opening in the offset transverse plate 43 provided with perforations as shown at 44–45, and the amount of this offset makes it possible to decrease the overall height or extension of the assembly beyond the end of the container 35. The conical configuration of this offset also provides a self-centering feature for locating the nozzle 40 with respect to the conical surface 41 of the closure member. Tightening of the closure member 36 in its threaded engagement with the container forces the plate 43 downward, with the result that it takes its own position properly coaxial with the remainder of the assembly.

Figure 4:
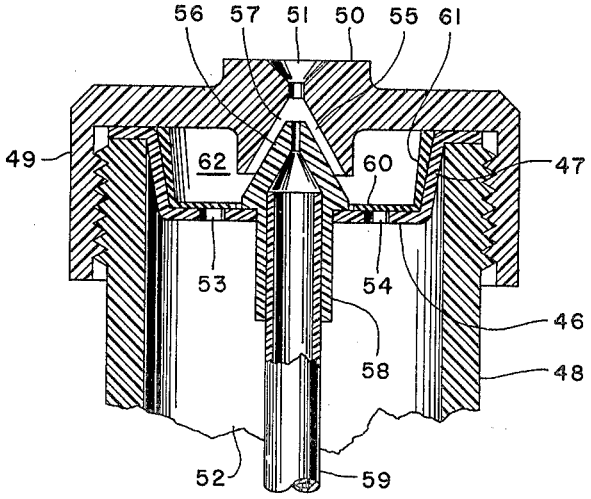
FIG. 4 illustrates a further modification of the invention incorporating a flap valve in the air passage in conjunction with an offset transverse plate.

Referring to FIG. 4, the offset transverse plate 46 has this same self-centering feature due to the tapered portion 47 engaging the opening of the neck 48 of the container. The closure member 49 also has threaded engagement with the neck 48, thus generating the necessary downward pressure to produce the self-centering tapering engagement. The FIG. 4 construction has a slightly different discharge orifice intersecting the top surface 50 of the closure member 49, as the presence of the bevelled adjacent surface 51 tends to generate a greater dispersal of the mist constituting the mixture of liquid with the pressurized air moving outwardly from the space 52 within the container, through the transverse plate apertures 53–54, and then through the passage 55 between the nozzle 56 and the conical inner surface 57 of the closure member 49. The lower extension 58 of the nozzle unit receives the withdrawal tube 59, and this interengagement is preferably secured with adhesive. The nozzle unit itself, as before, is press-fitted to a central opening in the transverse plate 47.

Figure 5:
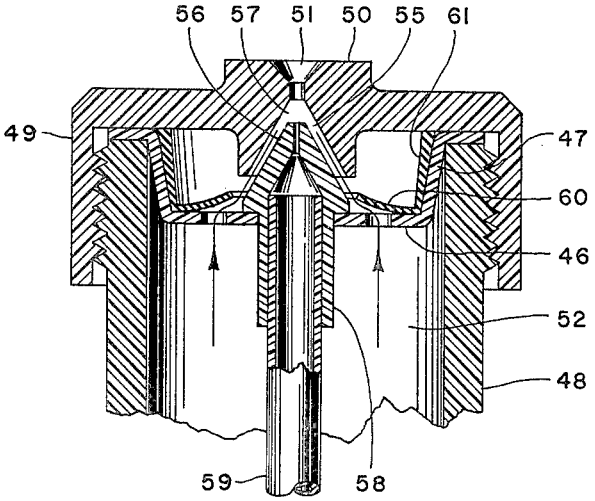
FIG. 5 is a view similar to FIG. 4, illustrating the valve in the open position permitting the passage of air.

Primarily as a means of preventing spillage of liquid from the container out through the perforations 53–54 of the plate 47, a flap valve of a resilent material such as rubber is mounted within the offset of the plate 47, and has a thin flap portion indicated at 60 directly overlying the central planar surface containing the perforations 53–54. The side portion of this valve member is indicated at 61, and lies along the surface of the plate offset 47. Since the height of the portion shown at 61 is equal to or slightly greater than, the amount of the offset, the underside of the closure member 49 confines the valve to its position shown in FIG. 4. In this position, liquid cannot spill out through the perforations, and accumulate in the space 62, or drain outward through the passage 55. On application of considerable pressure to the container, however, the air pressure within the space 52 increases to the point that the flap portions 60 is deflected upwardly away from the plate as shown in FIG. 5. This permits the passage of the pressurized air as indicated by the arrows. Return air to replace the volume of the ejected air and liquid is sucked in through the liquid-dispensing orifice, and thus tends to remove accumulated droplets where they may evaporate and congeal.

Figure 6:
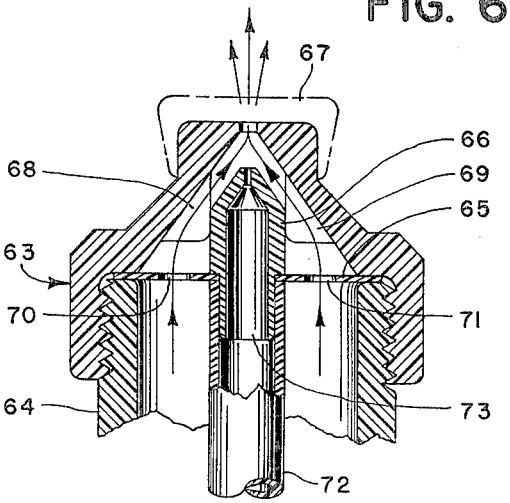
FIG. 6 illustrates a modified form of the invention incorporating a reception of the nozzle unit between portions of the closure member at a position axially spaced from the transverse plate.

Referring to FIG. 6, the closure member 63 is in threaded engagement with the neck 64 of a squeeze-bottle container, and the thin plate 65 is interposed between the neck 64 and the closure member to securely support the nozzle 66. A slip on-off cap is indicated in dotted lines at 67, and is optional. The underside of the closure member 63 is provided with a group of fins shown at 68–69 in FIG. 6, with these fins defining a central opening closely receiving the outer cylindrical surface of the nozzle 66. The space between the fins provides the air passage for the pressurized air moving from within the container out through the apertures 70–71 of the plate 65. The accommodation of the assembly of the closely-fitting relationship between the nozzle and the fins 68–69 is provided in two ways: (a) by the lateral shiftability of the plate 65 within the closure member prior to tightening the closure member down onto the neck, and (b) by the capability of the thin plate 65 to deflect in a somewhat sinusoidal pattern as the nozzle might be tilted slightly from the lateral pressure generated by the fins at a point substantially above the plate 65. In the FIG. 6 assembly, the withdrawal tube 72 is slipped over the outside diameter of the lower extension 73 of the nozzle unit, and adhesively secured in place so that the plate 65 is entrapped between these members. This eliminates the need of a press fit between the nozzle and the plate, unless additional security of mounting is desired. The self-centering relationship between the nozzle and the fins 68–69 will normally make it unnecessary to provide a particularly firm interengagement between the nozzle and the plate.

Referring to FIG. 7, the threaded engagement between the neck of the container 74 and the closure member 75 securedly clamps the transverse plate 76 in position. As in the FIG. 6 structure, the lateral shiftability and deflection of this plate accommodate the self-centering between the central cylindrical bore 77 of the closure member and the outer ridges provided by the polygonal exterior cross section of the nozzle shown at 78. Air passages are provided by the space between the flat surfaces of this cross-section and the surface of the bore 77. The withdrawal tube 79 is slipped over the lower extension 80 of the nozzle unit so that the tube 79 and the nozzle unit are axially fixed with respect to the plate, and thus properly located with respect to the inside surface 81 adjacent the discharge orifice 82.

FIG. 8 illustrates another form of the self-centering feature, in which the exterior generally conical portion 83 of the nozzle unit 84 is provided with grooves as shown at 85 forming, with the inside conical surface 86 of the closure member 87, air passages leading from the clearance space 88 communicating (through the aperture 89,90) with the space 91 within the container 92. In the FIG. 8 assembly, the transverse plate 93 is integral with the nozzle unit, and has the lower extension 94 receiving the withdrawal tube 95. The solid interengagement between the conical surface 86 and the tapered portion of the nozzle 83 establishes the necessary close centering, and is accommodated by the lateral shiftability of the plate 93 prior to tightening the threaded engagement between the closure member 87 and the container 92.

Referring to FIG. 9, a modified form of the invention is illustrated in which the squeeze-bottle container 96 has a laterally offset portion shown at 97, with opposite recesses as indicated at 98 permitting the portion 97 to be used as a handle. Since this is still a part of the manually-deformable container 96, squeezing the handle will have the same effect as squeezing any other part of the container. The presence of the handle immediately adjacent the nozzle and closure member assembly 99 has the natural effect of a placing the nozzle in the air space resulting from any inclined position, as shown in FIG. 10. In a container of this type, it is preferable to limit the air passages in the transverse plate to one side, as indicated at *99a*, which is the side most likely to remain in the air space. The withdrawal tube 100 maintains its position immersed in the liquid, so that the desired air-liquid relationship of the discharge from the container can be maintained.

FIGS. 11 and 12 are enlarged views of an anti-leakage valve that can easily be inserted in the lower extremity of a liquid-withdrawal tube of the type shown at 100 in FIGS. 9 and 10. The intake end of the tube 101 receives an insert of highly resilient material such as rubber, which has a cylindrical portion 102 received within the inside diameter of the withdrawal tube. The normal position of the portion 102 of this valve appears in FIG. 12. Application of exterior pressure, however, has the effect of deflecting the portion 102 into the FIG. 11 position, permitting liquid to proceed inward through the opening 103 in the wall in the tube 101. A shoulder 104 associated with the internal portion 102 of the valve member assists in maintaining the proper assembled relationship.

Figure 13:
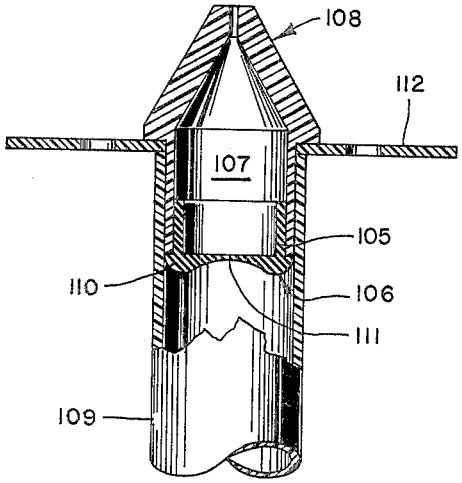
FIGS. 13 and 14 illustrate the closed and open positions of a similar form of check valve installed at the opposite extremity of the liquid conduit.
Figure 14:
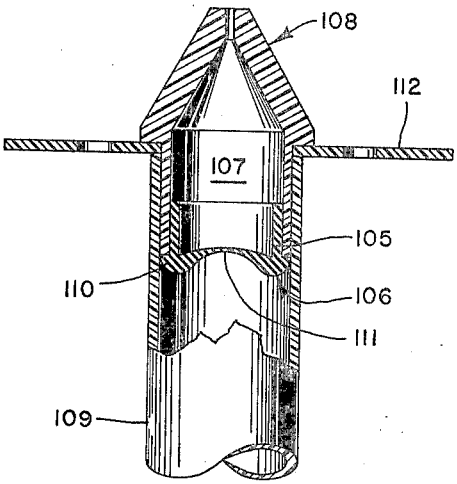

FIGS. 13 and 14 illustrate another valve having a similar function, in which the generally cylindrical portion 105 of the valve member 106 is received within the lower extension 107 of the nozzle 108, rather than at the lower end of the withdrawal tube 109, as shown in FIGS. 11 and 12. The valve unit has a transverse portion 110 with a central discontinuity 111 in a thin portion capable of opening when the unit is deflected upwardly under pressure, as shown in FIG. 14. A convenient peripheral shoulder on the cylindrical portion 105 serves to locate the valve member with respect to the nozzle unit, and is preferably of sufficiently limited diameter so that it does not project radially beyond the extension 107 to interfere with the reception of the withdrawal tube 109. The transverse perforate support plate 112 functions are previously described. The arrangement shown in FIGS. 11–12 and 13–14 both have the effect of sealing off the flow of liquid in the absence of manually-applied pressure on the associated container. Suction resulting from release of manual pressure on the container should pull in the necessary displacement air on opposite deflection of the FIGS. 9–10 version, and through other passages in the FIGS. 11–12 form.

Figure 15:
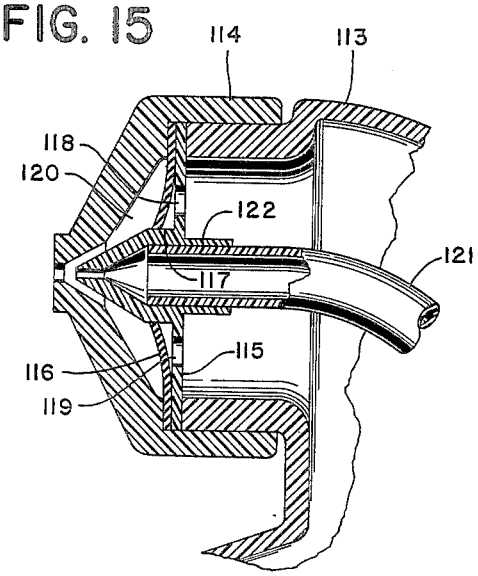
FIGS. 15 and 16 illustrate the closed and opened positions, respectively, of a flap valve in the air passage, with the closed position in FIG. 15 sealing around the cylindrical outside diameter of the nozzle unit.
Figure 16:
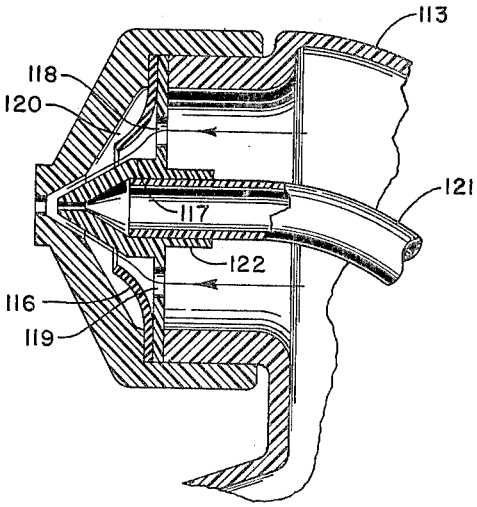

Referring to FIGS. 15 and 16, a modified form of the invention shows a type of valve for sealing off the air passage against leakage of liquid, and is particularly well adapted to the sort of inclinable container shown in FIGS. 9 and 10. The container 113 is equipped with the closure member shown at 114, and the transverse plate portion of an integral plate-nozzle unit is entrapped between the container and the closure member as previously described. Additionally, however, a washer-shaped valve 116 is also entrapped in the same manner. This valve is also of a highly resilient material such as rubber, and has a central opening having a preferably forced fit relationship with the cylindrical portion 117 of the nozzle unit. in the position illustrated in FIG. 15, this provides a sealing arrangment blocking liquid from entering the space 120 inside the closure member 114. Application of pressure by squeezing the bottle 113 deflects the member 116 away from the cylindrical portion 117 of the nozzle to provide for the passage of pressurized air through the nozzle assembly as previously described. The withdrawal tube 121 is preferably adhesively secured to the sleeve portion 122 of the plate-nozzle unit.

Figure 17:
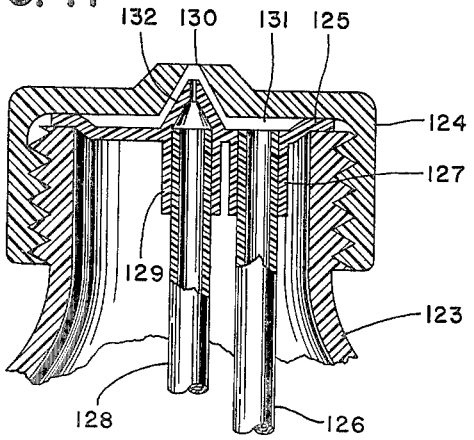
FIG. 17 illustrates a modification of the invention providing a separate air conduit, this assembly being associated with the system illustrated in FIG. 19.
Figure 18:
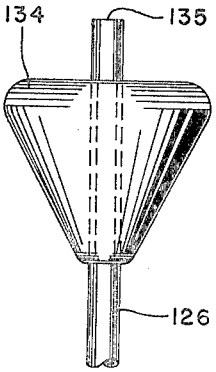
FIG. 18 illustrates a float arrangement, on an enlarged scale, for use in conjunction with the container of the type shown in FIG. 19.
Figure 19:
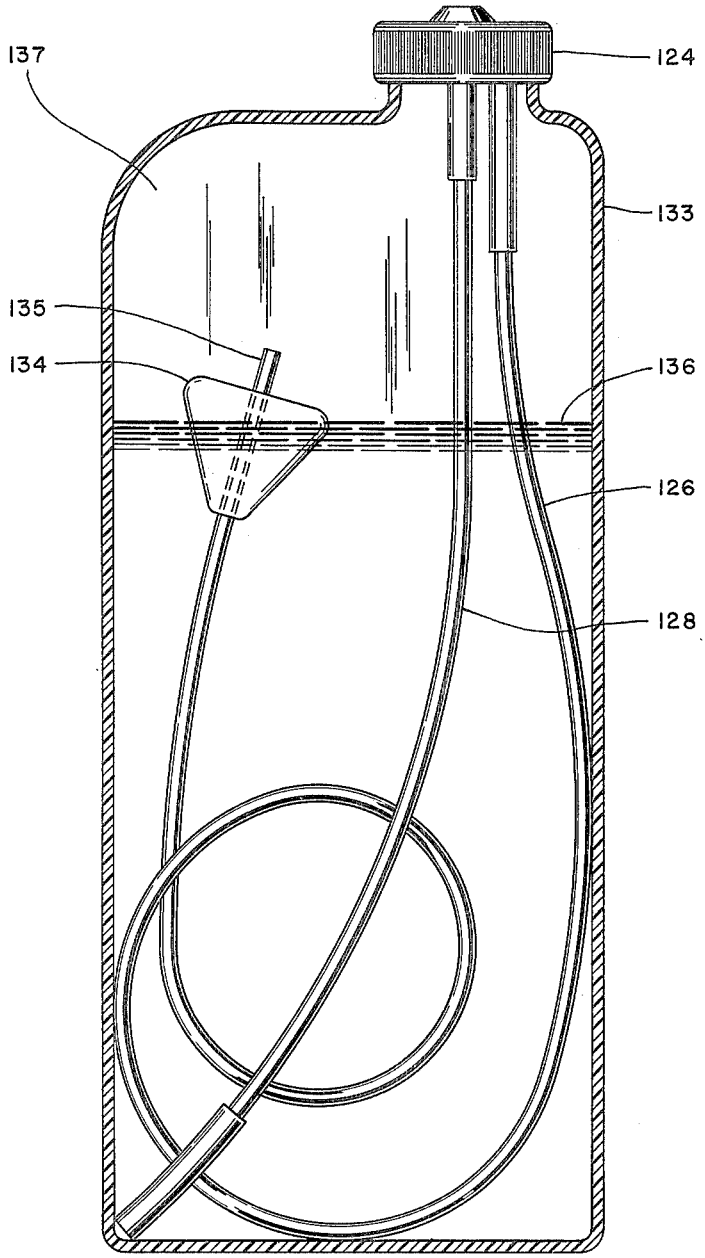
FIG. 19 is a sectional elevation showing a container incorporating both a liquid-withdrawal tube and also an air conduit having the free end positioned in the air space within the container by a float.

Referring to FIG. 17, the squeeze bottle 123 has the closure member 124 in threaded engagement, with the transverse plate 125 entrapped between them. This modification of the invention, however, provides a separate air conduit 126 receive within the generally cylindrical section 127 integral with the transverse plate 125. The liquid-withdrawal tube 128 is received by a similar section 129, which is concentric with the axis of the discharge orifice 130. The downward offset of the plate 125 provides the space 131 for the movement of the air out from the conduit 126 to the passage between the nozzle 132 and the internal conical surface leading to the orifice 130. The assembly shown in FIG. 17 is associated with the container 133 shown in FIG. 19, and the free end of the air conduit 126 is provided with the float 134 to maintain the air inlet 135 at a position always above the surface of the liquid indicated at 136. The air inlet 135 is thus always within the air space 137 above the liquid, regardless of the orientation of the container. The air conduit 126 is preferably coiled as shown to minimize a tendency for the stiffness of the tubing to submerge the float.

I claim:

1. An atomizing liquid dispenser including a manually defomable container having an opening, and a closure member for said opening provided with a discharge orifice, and also including a liquid-dispensing nozzle operative to discharge liquid via a liquid outlet through said orifice, and a cap extending over said orifice and the end of said nozzle, said orifice and nozzle defining between them an air passage communicating with said container, wherein the improvement comprises:

a transverse perforate plate supporting said nozzle, (a) said plate being interposed between said container and said closure member, (b) said nozzle having a portion containing said outlet normally projecting outwardly beyond said closure member, (c) said cap and closure member being in threaded engagement, and (d) said plate being resilient as a diaphram to a degree such that manually tightening said cap induces at least partial retraction of said nozzle within said orifice, and resilient closure of said outlet and subsequent closure of said orifice around said outlet.

* * * * *